United States Patent [19]

Schuh

[11] 4,339,005

[45] Jul. 13, 1982

[54] CURVED WELL CONDUCTORS FOR OFFSHORE PLATFORM

[75] Inventor: Frank J. Schuh, Dallas, Tex.

[73] Assignee: Atlantic Richfield Company, Los Angeles, Calif.

[21] Appl. No.: 167,544

[22] Filed: Jul. 10, 1980

[51] Int. Cl.[3] ..... E21B 7/08

[52] U.S. Cl. ..... 175/9; 175/61; 175/75

[58] Field of Search ..... 175/61, 9, 62, 75, 79

[56] References Cited

U.S. PATENT DOCUMENTS

| | | | |
|---|---|---|---|
| Re. 28,860 | 6/1976 | Marshall et al. | 175/9 |
| Re. 29,929 | 3/1979 | Horuath | 175/61 |
| 2,336,334 | 12/1943 | Zublin | 175/75 |
| 2,344,277 | 3/1944 | Zublin | 175/61 |
| 2,382,933 | 8/1945 | Zublin | 175/61 |
| 3,451,493 | 6/1969 | Storm | 175/9 |
| 3,687,204 | 8/1972 | Marshall et al. | 175/61 |
| 4,249,619 | 2/1981 | Burns | 175/61 |

*Primary Examiner*—James A. Leppink

*Attorney, Agent, or Firm*—Richards, Harris & Medlock

[57] ABSTRACT

A method and apparatus for installing a curved well conductor (22) from an offshore marine structure (10) utilizes a leading section of precurved pipe (26) along with a plurality of trailing sections of initially straight pipe (24). The precurved pipe (26) is releasably straightened as the conductor (22) is lowered from the marine structure (10). Upon engagement with the sea floor, the precurved pipe (26) is released to resume its original curvature. The trailing initially straight sections of pipe (24) are then forced to follow a curved path defined by the leading section as the well conductor (22) is driven into the sea floor.

16 Claims, 12 Drawing Figures

CURVED WELL CONDUCTORS FOR OFFSHORE PLATFORM

TECHNICAL FIELD

The present invention relates generally to offshore drilling technology, and more particularly to a method and apparatus for producing oil and gas from geological formations beneath the ocean floor.

BACKGROUND ART

An increasing amount of offshore petroleum exploration is being conducted at sites off the coasts of Alaska, California, Louisiana and Texas, and most recently in the North Sea. A drilling platform is typically installed on or over the sea floor at the desired site, after which a string of outside well conductors or pipes are lowered from the platform and driven into the sea floor to provide guidance and support for wells drilled into the hydrocarbon-bearing formations. Fluids produced from the formations are conducted to the surface through the casing and tubing set inside the well conductors.

Since it is not always possible to locate a drilling platform immediately above a formation, it is highly desirable in such situations to utilize well conductors having increased lateral reach or deviation from the vertical. For example, if the local soil conditions on the sea floor are such that mud slides could occur, a condition which is frequently encountered when drilling in the Gulf of Mexico near the mouth of the Mississippi River, such a site would not provide stable support for a platform and would therefore be unacceptable even though promising formations could lie underneath the area. More importantly, increasing the deviation or lateral reach of the well conductors enlarges the potential drainage area which can be explored from a single platform, and thus enhances the chances of making a productive discovery.

Various techniques have been developed for extending the lateral reach of well conductors. U.S. Pat. No. 3,451,493 to Storm discloses a drilling apparatus and method wherein straight well conductors are driven at an angle into the sea floor through guide tubes mounted in predetermined slanted orientation on the platform structure. The conductors thus extend outside the platform structure in the water, a condition which is undesirable since relatively long spans of unsupported well conductors may require construction of guides or supports external to the main framework of the platform. Such an arrangement is both costly and complicated, and may not provide sufficient lateral resistance to serve as a portion of the platform foundation. Moreover, special slant-type drilling rigs must be used instead of conventional straight rigs.

An alternative arrangement is to locate the well head for each straight conductor at the side of the platform such that the conductors criss cross in the water substantially inside the framework of the platform. This arrangement, while facilitating construction of guides and supports for the slanted conductors, consumes a large amount of deck space on the platform since the wellheads are not located together. In addition, this technique may result in an undesirable well conductor reach pattern.

More recently, curved conductors have been devised in an attempt to overcome some of the foregoing difficulties. For example, U.S. Pat. No. Re. 28,860 to Marshall et al discloses a technique wherein the conductor guides are mounted in an arc on the supporting framework of the platform. Precurved conductor pipe is inserted in the curved portion of the guides, from the bottom of the rig while onshore, and connected to straight conductor that extends to the rig. The preinstalled conductor pipe is then temporarily secured in place within the guides until after installation of the platform. Straight conductor sections thereafter connected and driven downwardly through the guides are deformed into an arcuate configuration which continues to build curvature as the conductors are extended downwardly and outwardly into the sea floor. Special slant-type drilling rigs are not necessary because the upper portion of each such well conductor is vertical.

Both of the foregoing techniques, however, suffer from the common disadvantage of being difficult to aim. Since the guides for the conductors are fixed to the platform in a predetermined arrangement, it will be appreciated that the platform must be oriented in the desired direction at the time of installation. The aiming direction of the conductors is thus determined at the time of installation of the platform, and cannot be changed thereafter except through reorientation of the platform. Drilling from such platforms is thus limited to the general directions of the conductors upon installation of the platforms.

A need has thus arisen for an improved method and apparatus for installing curved conductors which affords more flexibility in aiming the conductors and which is not dependent upon orientation of the offshore platform.

SUMMARY OF THE INVENTION

The present invention comprises an improved technique for installing curved conductors which overcomes the foregoing and other difficulties associated with the prior art. The invention herein eliminates the need for special planning and orientation of the offshore platform at the time of installation, and permits more flexibility in aiming the curved well conductors.

More particularly, the present invention comprises a method and apparatus for installing curved conductors from an offshore drilling platform in the exploration for and/or production of hydrocarbon fluids from formations beneath the sea floor. The technique herein utilizes a well conductor which includes a precurved section at the leading end but which is otherwise substantially straight initially. In the first embodiment, the well conductor is driven through a straight guide sleeve on the platform extending through the water to the sea floor. Upon exiting the sleeve, the leading section resumes its original curvature and establishes a curved path downwardly and outwardly under the sea floor as the well conductor is driven through the sleeve. The reaction forces of the soil underneath the sea floor cause the straight section of well conductor to follow the arcuate path established by the precurved leading section.

In the second embodiment, the precurved leading section is straightened by a releasable mandrel therein so that the conductor can be lowered into the sea floor through vertically aligned guides on the platform. After the conductor has penetrated the sea floor, the mandrel is released and withdrawn allowing the precurved leading section to resume its original curvature. The well conductor is aimed by orienting the plane of curvature of the leading section in the desired direction at the time of insertion into the upper end of the vertical guide or sleeve structure.

BRIEF DESCRIPTION OF DRAWING

A better understanding of the invention can be had by reference to the following Detailed Description in conjunction with the accompanying Drawing, wherein.

DETAILED DESCRIPTION

Figure 1:
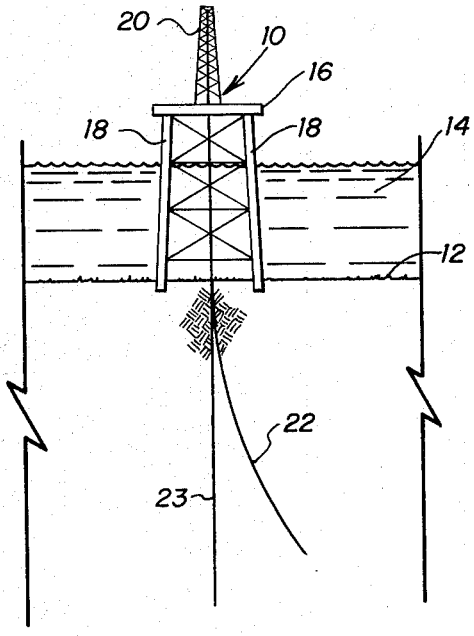
FIG. 1 is an illustration of an offshore drilling platform with a curved well conductor installed in accordance with the present invention.

Referring now to the Drawing, wherein like reference numerals designate like or corresponding elements throughout the views, FIG. 1 shows a conventional offshore drilling platform structure 10 resting on the floor 12 of a body of water 14. Structure 10 includes a generally horizontal work platform 16 by a plurality of cross-braced legs 18 extending downwardly through water 14. The lower ends of legs 18 extend into floor 12 and are anchored in place by piles extending through the legs. A derrick 20 is mounted on platform 16 together with other conventional drilling and production equipment, including draw works, engines, etc. (not shown).

In accordance with the invention, a curved well conductor 22 extends downwardly from platform structure 10 into floor 12 of water 14. Conductor 22 provides guidance and support for the various tools utilized in drilling into a formation beneath floor 12, and serves as a conduit for the casing and tubing through which fluids from the formation are produced. The upper end of well conductor 22 thus comprises the base of the wellhead. That portion of well conductor 22 extending between platform 16 and floor 12 is substantially vertical. Beginning at a point just beneath floor 12, well conductor 22 continually curves downwardly and outwardly in the desired direction, as will be explained more fully hereinafter.

If desired, platform structure 10 can also include a straight well conductor 23 extending into sea floor 12 in a vertical direction beneath the rig.

Although a single curved well conductor 22 has been illustrated with a conventional offshore platform structure 10 of the legged type, it will be understood that a plurality of such well conductors can be utilized together with one or more straight conductors on other types of offshore marine platforms in accordance with the invention. Typically, a plurality of well conductors 22 would be used with offshore platform structure 10.

Figure 2:
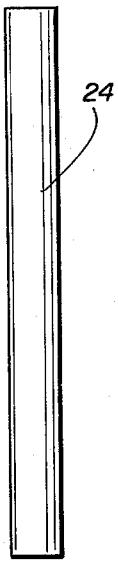
FIGS. 2 and 3 are illustrations of the two types of conductor sections useful in practicing the invention.
Figure 3:
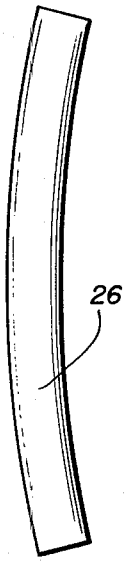
Figure 4:
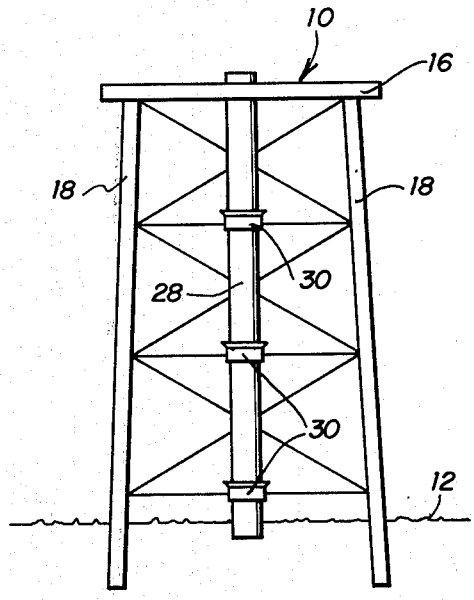
FIGS. 4–8 are illustrations of a method for installing a curved well conductor in accordance with the first embodiment of the invention.

Referring now to FIGS. 2 and 3, well conductor 22 includes a precurved leading section but is otherwise substantially straight in initial condition. Preferably, well conductor 22 is comprised of a plurality of initially straight conductor sections 24 secured in end to end relationship behind a leading precurved conductor section 26. Each conductor section 24 and 26 can be, for example, a section of pipe about 40 feet long and about 24 inches in outside diameter with a wall thickness of about 0.75 inch. The curvature of conductor section 26 can be up to 6° per 100 feet. Conductor sections 24 do not remain straight during installation of well conductor 22, but are forced to follow the curved path established by the leading precurved section 26 as the well conductor is driven into sea floor 12.

FIGS. 4–8 illustrate a method and apparatus for installing a curved well conductor 22 in accordance with the first embodiment of the invention. Platform structure 10 is provided with a straight guide sleeve 28 extending downward in a vertical direction from platform 16. The lower end of guide sleeve 28 is positioned adjacent to floor 12, and preferably penetrates the soft top surface of floor 12. Guide sleeve 28 can be lowered in place through an opening (not shown) in platform 16 and supported by conventional platform guides 30 after installation of the platform at the drilling site, or permanently installed on the platform during construction onshore. Guide sleeve 28 can comprise a plurality of pipe sections sized to snugly receive well conductor 22. For example, guide sleeve 28 may be of 26 inch outside diameter and 0.5 inch wall thickness in the case of well conductor 22 with 24 inch outside diameter.

Figure 5:
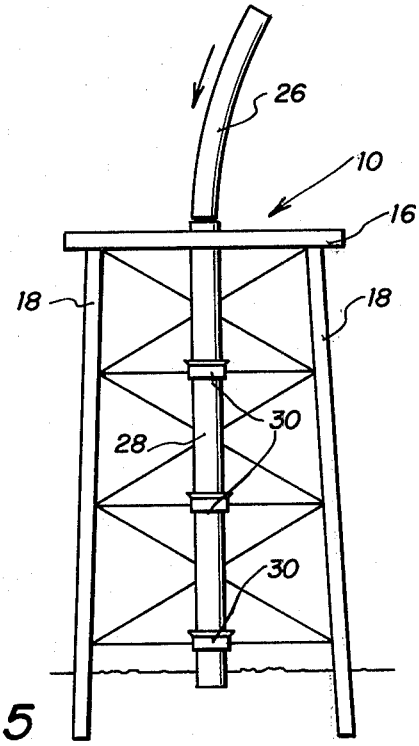
Figure 6:
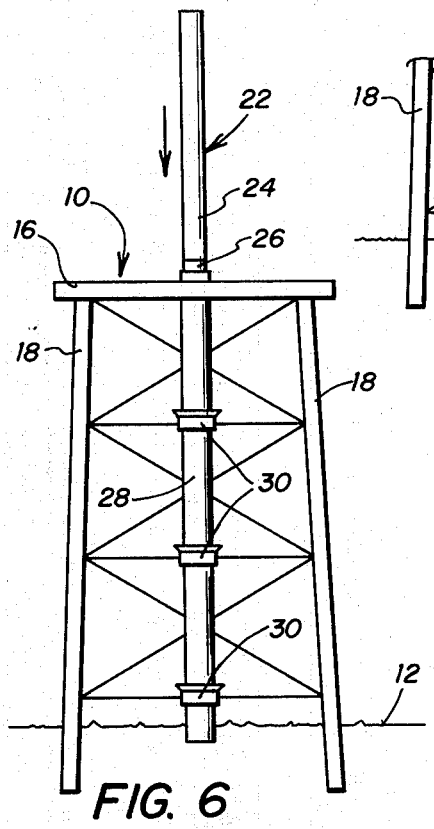

After platform structure 10 has been installed at a particular location and guide sleeve 28 has been installed, a precurved section 26 of well conductor 22 is inserted into the upper end of guide sleeve 28 as shown in FIG. 5. Precurved conductor section 26 is elastically straightened as it is forced into guide sleeve 28. It is most important that conductor section 26 not be yielded as it is straightened within guide sleeve 28 so that the leading section of well conductor 22 will resume its curvature upon exiting the guide sleeve. After conductor section 26 has been pushed sufficiently far into guide sleeve 28, the first of a series of following straight sections 24 is secured thereto as shown in FIG. 6 to build well conductor 22 as it is driven downwardly through guide sleeve 28. Conductor sections 24 and 26 can be secured together in serial relationship by means of welding or suitable fasteners.

Figure 8:
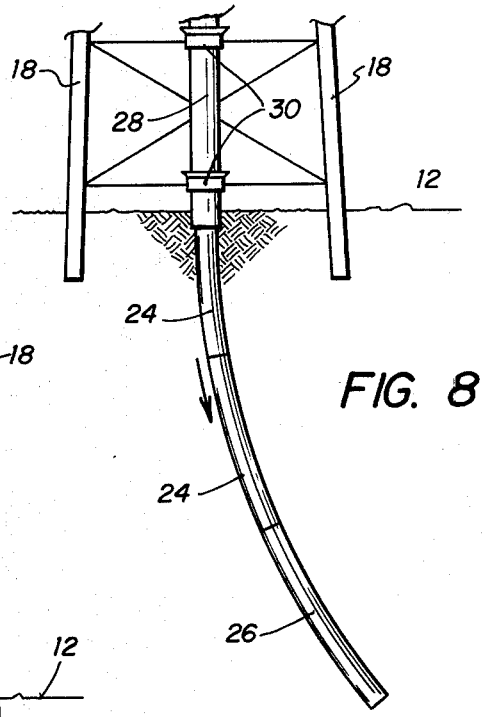
Figure 7:
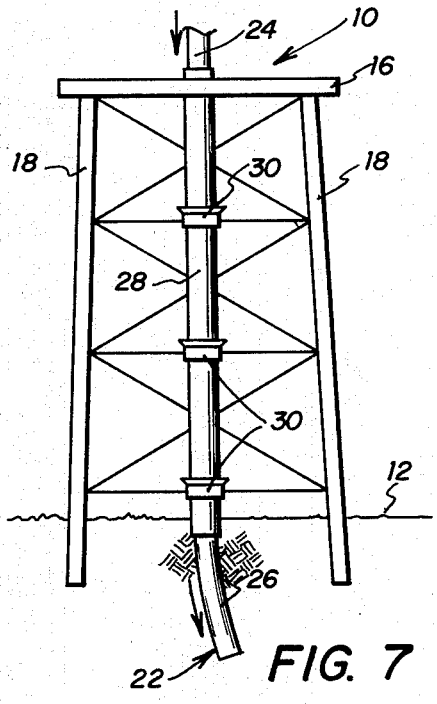

With reference to FIGS. 7 and 8, the leading precurved section 26 resumes its original curvature as the well conductor 22 is driven out of guide sleeve 28. Those skilled in the art of offshore drilling will appreciate the fact that the soil comprising the uppermost layer of floor 12 is generally soft whereby return of conductor section 26 to its original curvature is easily accommodated. Well conductor 22 thus follows the curvature established by precurved section 26 as it is driven into sea floor 12. The initially straight conductor sections 24 are forced to curve and follow this path as shown in FIG. 8 by the reaction forces of the relatively firm soil beneath floor 12 as well conductor 22 is driven downwardly. After the well conductor 22 has been driven to the desired depth, which may be 150 to 300 feet or more below sea floor 12, it will be appreciated that the lowermost end thereof is substantially deviated in a horizontal direction from a vertical line extending through sleeve 28. Drilling and production can then proceed via well conductor 22.

Figure 9:
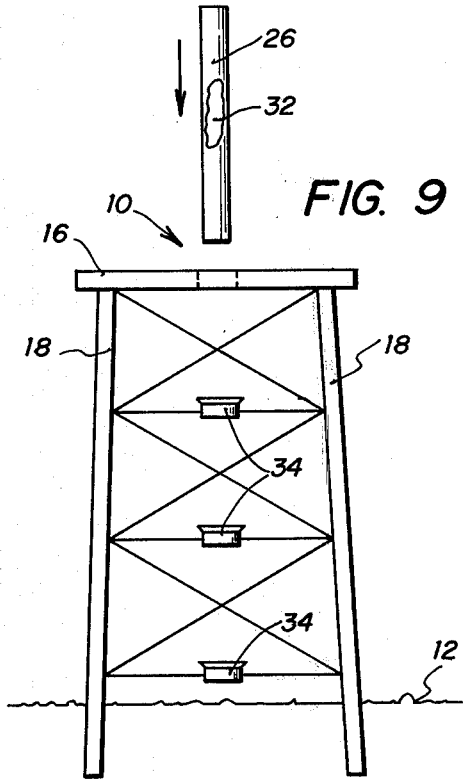
FIGS. 9 and 10 are illustrations of a method for installing a curved well conductor in accordance with the second embodiment of the invention.
Figure 10:
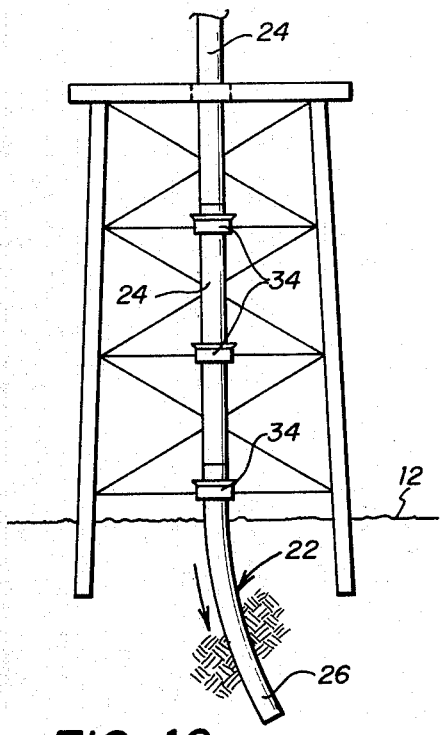

FIGS. 9 and 10 illustrate a method and apparatus for installing a curved well conductor 22 in accordance with the second embodiment of the invention. Instead of an external guide sleeve 28, the second inventive embodiment utilizes an internal mandrel 32 for elastically staightening section 26 as it is lowered downwardly through a plurality of guides 34 mounted in vertically spaced relationship on the cross-braces between legs 18 of platform structure 10. Mandrel 32 can be of any suitable construction.

Well conductor 22 is built up in similar manner by connecting sections 24 in end to end relationship behind section 26. After the bottom end of well conductor 22 has penetrated the relatively soft mud of floor 12, mandrel 32 is released and withdrawn thereby allowing section 26 to resume its original curvature. The straight sections 24 of well conductor 22 are forced by the relatively firm soil underneath floor 12 to follow the curved path established by section 26 as the well conductor is driven into floor 12.

Figure 12:
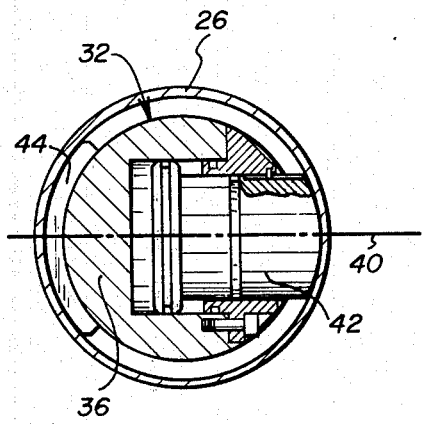
FIG. 12 is a sectional view taken along lines 12—12 of FIG. 11 in the direction of the arrows.
Figure 11:
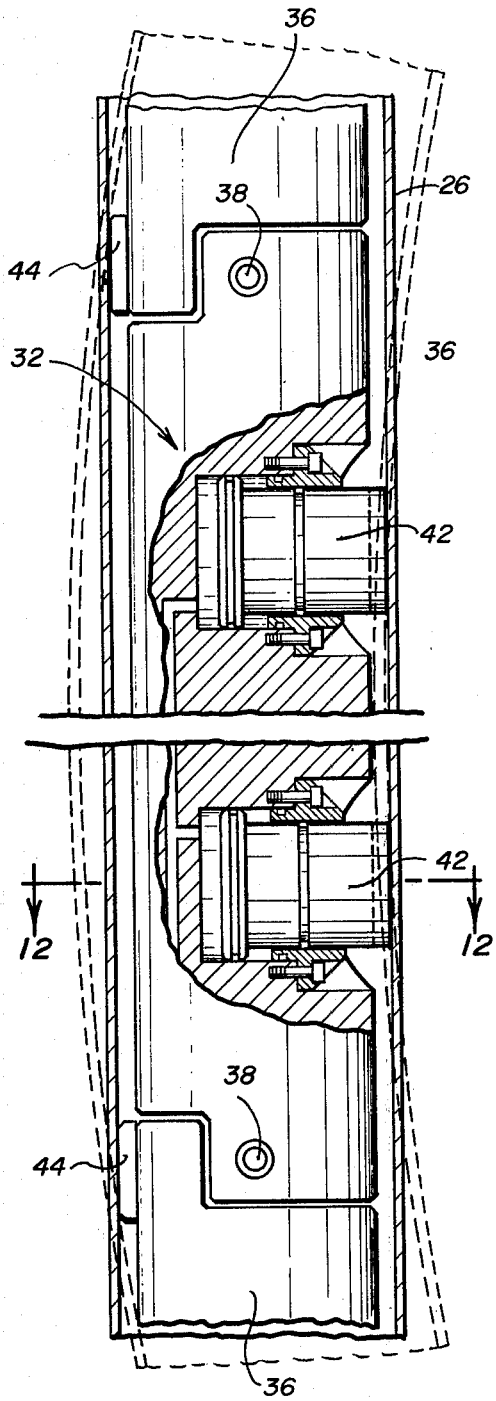
FIG. 11 is an enlarged side view (partially cut away) of a mandrel for releasably straightening the precurved leading conductor section in the second embodiment of the invention.

Referring now to FIGS. 11 and 12, further constructional details of mandrel 32 can be seen. Mandrel 32 is preferably substantially equal in length to precurved section 26, and is of segmented construction. For example, mandrel 32 can be constructed of four segments 36 each about ten feet in length. Adjacent pairs of mandrel segments 36 are interconnected by hinge pins 38 oriented transverse to the plane of curvature 40 of the conductor section 26. Each segment 36 includes a pair of double-acting cylinders 42 oriented in the plane of curvature 40 toward the center of curvature of section 26. In a ten foot segment 36, for example, cylinders 42 can be positioned about 22 inches inward from pins 38.

A reaction shoe 44 is mounted on the opposite side of each mandrel segment 36 adjacent to hinge pins 38. When cylinders 42 are relaxed, mandrel 32 thus can be moved through conductor section 26. Section 26 is releasably straightened but not yielded when cylinders 42 of mandrel 32 are pressurized. In actual practice, the precurved conductor section 26 is bowed slightly outward against the original curvature over each mandrel segment 36 such that the section is substantially straightened sufficiently to pass through guides 34.

With regard to aiming either embodiment of the present invention, it will be appreciated that the well conductor 22 can be aimed by orienting the plane of curvature of precurved section 26 in the desired direction as the well conductor is lowered from platform structure 10. Aiming of the well conductor 22 therefore is not dependent upon precise positioning at the time of installation of platform structure 10. Besides facilitating installation of structure 10, this affords greater versatility in the placement of well conductor 22 and increases the area which can be explored and/or produced from a single marine structure. After a well has been drilled in one direction, the results can be analyzed and used in selecting the direction of the next well to be drilled. These advantages comprise significant features of the present invention.

From the foregoing, it will be apparent that the present invention comprises an improved technique for installing curved well conductors which has numerous advantages over the prior art. Aiming of the well conductor can be accomplished substantially independently of the orientation of the offshore marine structure. One or more curved well conductors in accordance with the invention can be used in combination with straight vertical conductors to increase the number of wells which can be drilled from a single offshore platform. Further, conventional vertical-type equipment and techniques can be employed to install and drill through the curved well conductor herein. Other advantages will be apparent to those skilled in the art.

Although particular embodiments of the invention have been illustrated in the accompanying Drawing and described in the foregoing Detailed Description, it shall be understood that the invention is not intended to be limited only to the embodiments disclosed, but embraces any alternatives, equivalents, modifications and rearrangements of elements as fall within the scope of the invention as defined by the following Claims.

I claim:

1. A method of installing a solid walled curved well conductor on an offshore platform located above a body of water, comprising the steps of:

providing a staight guide sleeve on the offshore platform;

forming a predetermined curvature being greater than the inside diameter of the straight guide sleeve in the lowermost portion of said well conductor with the remaining portion thereof being substantially straight;

releasably straightening the lowermost portion of said well conductor without yielding the material thereof;

lowering said straightened well conductor through the straight guide sleeve downward from the offshore platform into contact with the floor of the body of water;

releasing the lowermost portion of said well conductor upon exiting the straight guide sleeve such that the lowermost portion resumes substantially its original curvature; and advancing said well conductor into the floor of the body of water downwardly and outwardly along a curved path established by the lowermost portion of said well conductor.

2. The method of claim 1, wherein the straight guide sleeve is provided to extend continuously from the offshore platform to the floor of the body of water.

3. The method of claim 1, wherein the lowermost portion of the well conductor is releasably straightened by inserting a mandrel into the lowermost portion of said well conductor and actuating said mandrel to substantially straighten the lowermost portion of said well conductor, and wherein the lowermost portion of the well conductor is released by deactuating said mandrel.

4. The method of claim 1, wherein the predetermined curvature formed in the lowermost portion of said well conductor is no more than 6° per 100 feet.

5. The method of claim 1, wherein said well conductor is lowered in a substantially vertical direction beneath the offshore platform.

6. A method of installing a solid walled curved well conductor on an offshore platform located over a body of water, comprising the steps of:

providing a straight guide sleeve extending from the offshore platform substantially to the floor of the body of water;

forming a predetermined curvature being greater than the inside diameter of the straight guide sleeve in the lowermost portion of the well conductor with the remaining portion thereof being substantially straight;

introducing said well conductor into the upper end of said guide sleeve such that the lowermost portion of said well conductor is elastically straightened therein; and advancing said well conductor through said guide sleeve and into the floor of the body of water such that the lowermost portion of said well conductor resumes its curvature upon exiting said guide sleeve and thereby establishes a curved path along which said well conductor curves downwardly and outwardly.

7. The method of claim 6, wherein the curvature of the lowermost portion of the well conductor is no more than 6° per 100 feet.

8. The method of claim 6, wherein said guide sleeve extends in a substantially vertical direction beneath the offshore platform.

9. The method of claim 6, wherein said guide sleeve is lowered through a plurality of guides mounted on structure attached to the offshore platform and into engagement with the floor of the body of water.

10. The method of claim 6, wherein said well conductor is introduced into said guide sleeve with the plane of curvature of the lowermost portion of said well conductor oriented such that the center of curvature thereof faces the desired direction.

11. The method of claim 6, including the step of conducting drilling operations through said curved well conductor.

12. A method of installing a solid walled curved well conductor on an offshore platform located over a body of water, comprising the steps of:

providing a plurality of guide sleeves mounted on structure attached to the offshore platform;

forming a predetermined curvature being greater than the inside diameter of the guide sleeves in the lowermost portion of said well conductor with the remaining portion thereof being substantially straight;

inserting a releasable mandrel into the lowermost portion of said well conductor;

actuating said mandrel to substantially straighten the lowermost portion of said well conductor without yielding the material of said well conductor;

lowering said straightened well conductor through the guide sleeves from the offshore platform into contact with the floor of the body of water;

deactuating and withdrawing said mandrel upon exiting the lowermost of the guide sleeves to allow the lowermost portion of said well conductor to resume substantially its original curvature; and advancing said well conductor into the floor of the body of water downwardly and outwardly along a curved path established by the lowermost portion of said well conductor.

13. The method of claim 12, wherein the curvature of the lowermost portion of the well conductor is no more than 6° per 100 feet.

14. The method of claim 12, wherein said well conductor is introduced into said guide sleeve with the plane of curvature of the lower portion of said well conductor oriented such that the center of curvature thereof faces the desired direction.

15. The method of claim 12, including the step of conducting well drilling operations through said curved well conductor.

16. Apparatus for directional drilling underneath the floor of a body of water comprising:

a working platform positioned over the surface of the body of water;

means for supporting said working platform on the floor of the body of water;

guide means positioned underneath said working platform and attached to said supporting means;

a solid walled well conductor having a first portion and a second portion extending downwardly from said working platform into the floor of the body of water;

said first portion of said well conductor having a predetermined curvature being greater than the inside diameter of said guide means and said second portion of said well conductor being substantially straight, such that said guide means receives said well conductor and releasably straightens said first portion of said well conductor below said working platform and above the floor of the body of water and releases said first portion to said predetermined curvature upon exiting said guide means to allow said well conductor to curve outwardly and downwardly beneath the floor of the body of water.

* * * * *